US007507052B2

(12) United States Patent
Griffiths

(10) Patent No.: US 7,507,052 B2
(45) Date of Patent: Mar. 24, 2009

(54) SPEED BUMP DEVICES

(75) Inventor: David Gardner Griffiths, 96 Parque Da Floresta, Budens, Vila Do Bispo (PT) 8650-060

(73) Assignee: David Gardner Griffiths, Vila Do Bispo (PT)

( * ) Notice: Subject to any disclaimer, the term of this patent is extended or adjusted under 35 U.S.C. 154(b) by 0 days.

(21) Appl. No.: 11/693,538

(22) Filed: Mar. 29, 2007

(65) Prior Publication Data

US 2008/0240856 A1 Oct. 2, 2008

(51) Int. Cl.
*E01F 11/00* (2006.01)

(52) U.S. Cl. ..... 404/11; 404/15

(58) Field of Classification Search ..... 404/15, 404/11, 13, 9, 6

See application file for complete search history.

(56) References Cited

U.S. PATENT DOCUMENTS 4,012,156 A * 3/1977 Turner et al. ..... 404/15
4,342,525 A * 8/1982 Mastronuzzi, Jr. ..... 404/6
4,974,991 A 12/1990 Mandavi
5,059,060 A * 10/1991 Steinhardt ..... 404/11
5,509,753 A 4/1996 Thompson
7,011,470 B1 * 3/2006 Breazeale et al. ..... 404/11
2002/0001505 A1 * 1/2002 Bond ..... 404/15

* cited by examiner

*Primary Examiner*—Gary S Hartmann
*Assistant Examiner*—Alina Schiller
(74) *Attorney, Agent, or Firm*—Victor N. King; Speckman Law Group PLLC

(57) ABSTRACT

A speed bump device is provided. The speed bump device comprises a first parallelogram frame, wherein the frame comprises an upper nested beam and a lower nested beam, wherein the upper beam and the lower beam are connected by way of at least one pivotable connecting arm, wherein the lower beam comprises at least one depression and at least one raised section, and wherein the upper beam is displaceable, relative to the lower beam, by way of the at least one connecting arm, from a retracted position, through a maximally extended position, to a raised position. A road surface element may suitably overlie the upper beam.

13 Claims, 5 Drawing Sheets

SPEED BUMP DEVICES

FIELD OF THE INVENTION

This invention relates to speed bump devices. Particularly, this invention relates to retractable speed bump devices suitable for use and installation on roads, streets, and the like.

BACKGROUND OF THE INVENTION

It is known that speed bumps are generally raised elements installed on roads or streets designed to discourage and prevent vehicles from travelling at high speed by way of giving jolts to the vehicles travelling too quickly over the speed bumps. However, there are instances when a speed bump is undesirable. For example, speed bumps are not desirable on roads where emergency vehicles frequently travel.

Several retractable speed bumps have been developed. U.S. Pat. No. 4,342,525 (Mastronuzzi, Jr.) discloses a retractable speed bump mounted in a street, road, or roadway for controlling the speed of vehicles, which includes a generally rectangularly-shaped encasement containing upper and lower, relatively movable, wedge-shaped members slidably fitted in the encasement and configured to cooperate by means of friction-reducing means such as ball bearings in adjacent, inclined faces to selectively raise the top of the upper member above street or road level responsive to activation of a hydraulic cylinder attached to the encasement and the lower member.

U.S. Pat. No. 4,974,991 (Mandavi) discloses a speed bump device which allows a vehicle to roll over the device slowly with little resistance. The speed bump device is provided with a lock which operates to lock the speed bump of the device in operative position when contacted by a vehicle wheel moving at a higher speed, thereby causing an appreciable bump effect. The speed bump device is also provided with a frame having a transverse bump bar at its upper end and a counterweight bar at its lower end. The frame is rotatably mounted by transverse axles secured to opposite sides of an open-topped container. In the resting position, the bump bar projects up above the open top. A lock arm projects rearwardly from and is rigidly interconnected to the frame for rotation therewith. It bears a vertical pendulum arm which rotates forwardly and rearwardly and which has a friction block at its lower end. A second friction block is mounted in the container below and to the rear of the first friction block. The two blocks contact and lock together to prevent continued rotation of the frame only when the bump bar is struck with sufficient force by a fast travelling vehicle wheel to swing the first friction block into the second block as the frame rotates. As a result, the bump bar remains up above the container to transmit a large bump to the vehicle, with the frame being locked in place.

U.S. Pat. No. 5,509,753 (Thompson) discloses a motorized retractable speed bump or warning device wherein the raising and lowering of the retractile is controlled by multiple remote means from signals generated by traffic conditions. The motorized retractable speed bump, wherein a retractile comprising of bi-folding hinged plates, which are elevated to present a visible obstruction to motor vehicles, and a position restraining device, operated by rotary and or linear motor drive means, by on/off manual push button switching, or through a series of Programmable Logic Controllers, by way of analogue or digital signals emanating from permanently mounted speed detecting devices.

The above-mentioned speed bump devices are unsuitable for use on roads and streets where heavy vehicles and vehicles carrying heavy loads travel.

SUMMARY OF THE INVENTION

Speed bump devices are provided. A bump is herein defined as a discontinuity in a road or street surface, such as a raised element, for the purpose of causing road users to traverse the bump at reduced speed. However, a person skilled in the art will appreciate that a dip in a road surface may also be used, in which case the bump is formed when the disclosed speed bump device is in a retracted position.

In one embodiment, the disclosed speed bump comprises a first parallelogram frame, wherein the frame comprises an upper and a lower nested beam connected to each other by way of a plurality of pivotable connecting arms. The lower beam comprises at least one depression and at least one raised section. By way of the connecting arms, the upper beam is displaceable, relative to the lower beam, from a retracted position where the upper beam nests in the lower beam's at least one depression, through a maximally extended position, to a raised position where the upper beam rests upon the at least one raised section of the lower beam.

The disclosed speed bump device may further comprise a second parallelogram frame, wherein the second parallelogram frame comprises an uppermost nested beam and an upper nested beams. The uppermost and upper nested beams are connected to each other by way of a plurality of upper pivotable connecting arms. In this embodiment, the upper beam comprises at least one depression and at least one raised section. By way of the upper pivotable connecting arms, the uppermost beam is displaceable, relative to the upper beam, from a retracted position where the uppermost beam nests in the upper beam's at least one depression, through a maximally extended position, to a raised position where the uppermost beam rests upon the at least one raised section of the upper beam.

In another embodiment, the disclosed speed bump device comprises a road surface element that covers the upper beam. The road surface element is not connected to the upper beam and is upwardly and downwardly movable by way of actions of the upper beam. In this embodiment, the road surface element may be mounted within guide means, whereby it is constrained to move only upwards and downwards with minimal sideways movement, and whereby the upper beam swings into its extended position with a sideway component to its path of movement.

The lower beam may be secured to a road surface or a sub-surface, and it may also be mounted in a frame, such a steel box. The disclosed speed bump device may be constructed of steel or any other suitable material. The road surface elements may comprise trays that are filled with a road-surfacing component, such as tar macadam, which may be used for the road surface adjacent the speed bump device.

In operation, the lower beam of disclosed speed bump device may be secured below, for example, a road surface, such that in a retracted position, the top side of the upper beam or a road surface element covering thereof lies substantially level with the road surface. The top side of the upper beam or road surface element covering thereof, in an extended position, forms the disclosed speed bump device. The upper and lower beams are nested, so that in a retracted position, the nested beams may come together, occupying a smaller effective space than its extended position, while being able to rest upon one another in both positions.

Forces exerted on a higher beam are readily transmissible to a beam on which it rests without necessarily passing through the connecting arms. The connecting arms, their pivot points, and any actuating mechanism for causing the displacement may therefore be more economically constructed as they do not need to be capable of bearing the maximum forces likely to be exerted between the beams, as compared to known speed bump devices where the means for bump extension is also the means for bump support.

The forces of a vehicle passing over the disclosed speed bump device are borne by the device's upper beam resting on the lower beam in an extended position. Similarly, the forces of a vehicle passing over the disclosed speed bump device are borne by the device's uppermost beam resting on the upper beam in an extended position. Thus, the disclosed speed bump device is particularly suitable for use on roads where large forces may be exerted by passing traffic. In one embodiment, the device is installed normal to the direction of traffic flow on the road, so that forces required for pivotally extending and retracting the upper or uppermost beam are substantially perpendicular to lateral forces imposed on the speed bump device by traffic traversing the device.

As the upper or the uppermost beam requires lifting to extend through a maximally extended position (relative to the beam below) when the beam is moved between the extended or retracted position, the weight of the beam acts to prevent accidental triggering of such movement. Such triggering otherwise, for example, caused by a passing vehicle, is thus unlikely.

Flaps, for example, in the form of hinged plates, may border the upper and/or uppermost beams, forming a bridge arrangement to smooth the transition between the road surface and the upper edge of the beam in its extended position. In one embodiment, edges of the speed bump device protruding above a road surface are provided with clear or colored reflective strips, dots, or the like to allow the device, in its extended position, to be highly visible to drivers. Such reflective elements are particularly useful when the speed bump device is deployed or extended in twilight, night, or foggy conditions.

The disclosed speed bump device may be operable by any convenient actuating mechanism, including, but is not limited to, manual, electrical, hydraulic, and pneumatic mechanisms. Such mechanism may act directly upon the upper or the uppermost beam, for example, by way of a piston or a solenoid arrangement. Alternatively, the piston or solenoid may act on one or more of the relevant arms, for example, by way of a geared motor rotating a pivotable shaft on which an arm is mounted, or by a ram pivotally connected between the beams. Other arrangements include: a winched steel cable with an optional pulley arrangement, a toothed belt arrangement, and a vertical 'metronome post' set at its upper end in an vertical slot in the beam, pivoted at its lower end for movement in the plane of the slot in the beam. A ratchet mechanism may be used with the above arrangements.

The disclosed speed bump device operable by non-manual actuating mechanisms may be controlled by way of methods known in the art, such as electronic controls. In one embodiment, an electronic control unit is used in conjunction with an electrically driven actuating mechanism. The electronic control unit may be actuated by way of radio control, control signals emitted by emergency vehicles, control signals emitted by traffic control systems, speed cameras, magnetic detector loops, and other known vehicle sensing mechanisms. The controls may comprise data processing capabilities to perform pre-selected functions, which are dependent upon data received.

BRIEF DESCRIPTION OF THE DRAWINGS

The present invention will be described in greater detail in the following detailed description, with reference to the accompanying drawings, wherein.

DETAILED DESCRIPTION OF THE INVENTION

Figure 1:
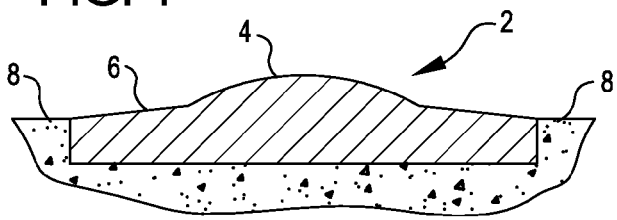
FIG. 1 is a cross-sectional end view of a speed bump device known in the art.

FIG. 1 shows a speed bump device 2 known in the art. Device 2 comprises a raised element 4 and lead up ramps 6, which forms part of road surface 8.

Figure 2:
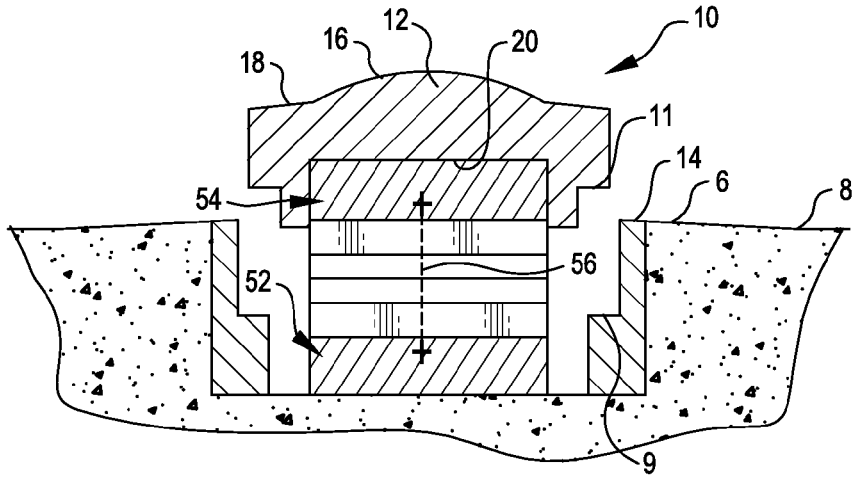
PRIOR ART FIG. 2
FIG. 2 is a cross-sectional end view of an embodiment of a speed bump device.
Figure 4:
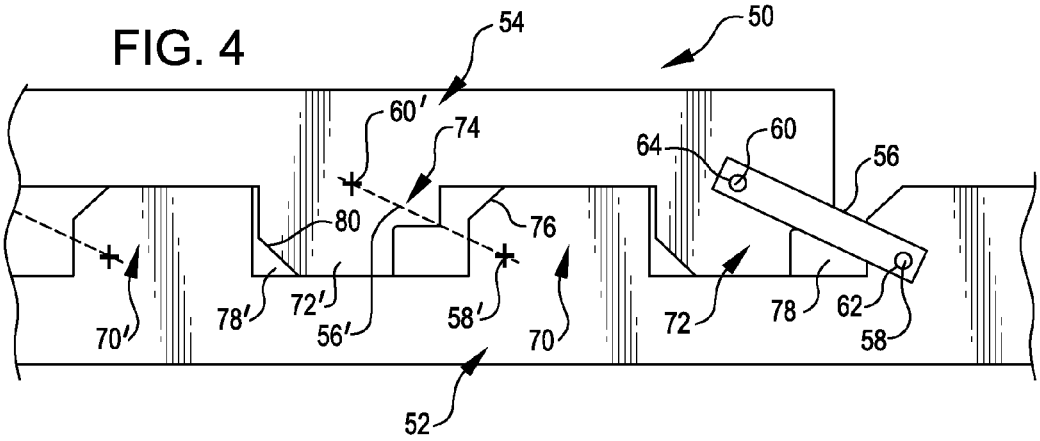
FIG. 4 is a side view of a parallelogram frame of the speed bump device shown in FIG. 2, arranged in a retracted position.

FIG. 2 shows an embodiment of the disclosed speed bump device 10. Speed bump device 10 comprises a moveable central road surface element 12 provided with a central raised portion 16 and shoulders 18. The road surface element 12 is positioned in guide means in the form of a frame 14 that is embedded in a road surface 8. Road surface 8 leads up to the frame 14 by way of ramps 6. The road surface element 12, extendable and retractable, is upwardly and downwardly movable within frame 14. The upward and downward movements are brought about by the action of an underlying parallelogram frame 50 as shown in FIG. 4, which will be further described below. An upper beam 54 of parallelogram frame 50 pushes against the underside 20 of the road surface element 12 when element 12 is being extended or raised, forming a bump.

Rotatable bearings, such as balls, needles, wheels, or roller bearings (not shown in the figures) is provided between the upper side of the upper beam 54 and the underside 20 of the road surface element 12 so that the upper beam 54 can slide relative to the road surface element 12 which overlies it. A ledge 9 within the frame 14 allows the road surface element 12 to be supported by a lip 11 when the parallelogram frame 50 is in a retracted position.

Figure 3:
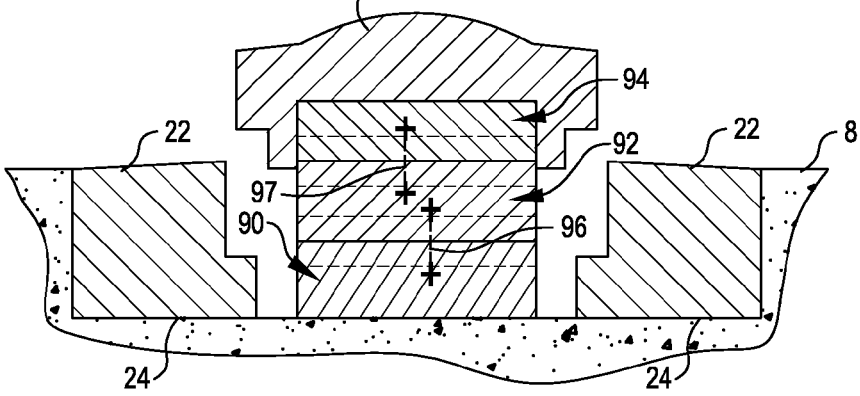
FIG. 3 is a cross-sectional end view of another embodiment of a speed bump device.

FIG. 3 shows another embodiment of the disclosed speed bump device. In this embodiment, speed bump device comprises extendable and retractable auxiliary road surface elements 22. Elements 22 can be extended or retracted relative to the road surface 8 and to the central road surface element 12. The auxiliary road surface elements 22 are extended and retracted by way of a second parallelogram frame, which will be further described below, pushing on under surface 24 of the auxiliary road surface elements 22.

Figure 5:
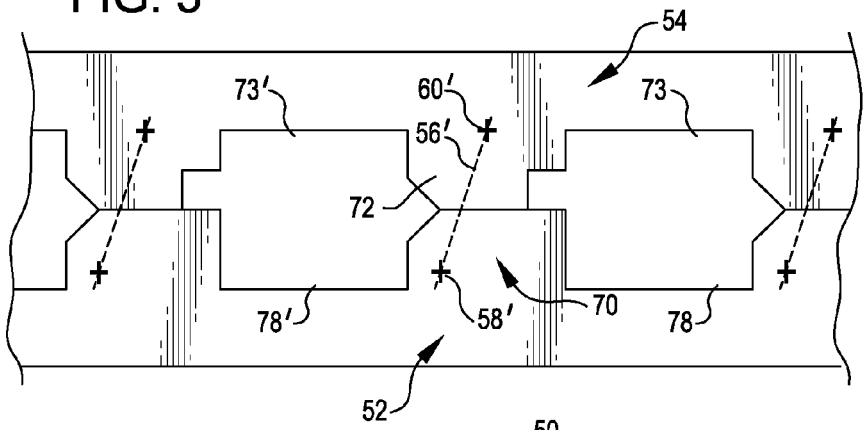
FIG. 5 is a side view of the parallelogram frame shown in FIG. 4, arranged in an extended position.

FIGS. 4 and 5 show the parallelogram frame 50 for use with the speed bump device as illustrated in FIG. 2. The parallelogram frame 50 comprises a lower beam 52 and an upper beam 54. Lower beam 52 is connected to upper beam 54 by way of at least two connector arms 56 and 56'. Only connector arm 56 is shown fully in FIG. 4 , connector arms 56' are shown schematically by way of a dashed line. Connector arm 56 is connected to the lower beam 52 at a pivot point 58 by way of a shaft 62. Connector arm 56 is connected to the upper beam 54 at a pivot point 60 by way of a shaft 64. The shafts 62 and 64 arc journaled in the beams by means of roller bearings. Shaft 62 is connected to an actuator mechanism (not shown) in the form of a geared electric motor that serves to rotate shaft 62. Connector arms 56 and 56' are capable of displacing upper beam 54 from a retracted position (as shown in FIG. 4) to an extended position (as shown in FIG. 5).

As shown in FIGS. 4 and 5, the lower beam 52 is provided a castellated upper surface comprising lands 70, 70' and wells 78, 78', and the upper beam 54 is provided with a castellated profile on its lower surface comprising extensions 72, 72' and indents 73, 73'. When the parallelogram frame is in the retracted position the extensions 72, 72' of upper beam 54 rest in the wells 78, 78' and the lands 70, 70' of the lower beam 52 rest in the indents 73, 73' of the upper beam 54. When frame 50 is in an extended position (FIG. 5), the extensions 72, 72' of the upper beam 54 rest on the extensions 70, 70' of the lower beam 52. In operation, an actuating mechanism serves to lift the upper beam 54 relative to the lower beam 52, and upper beam 54 pivots on the connector arms 56 and 56', expanding the parallelogram frame 50.

Figure 6:
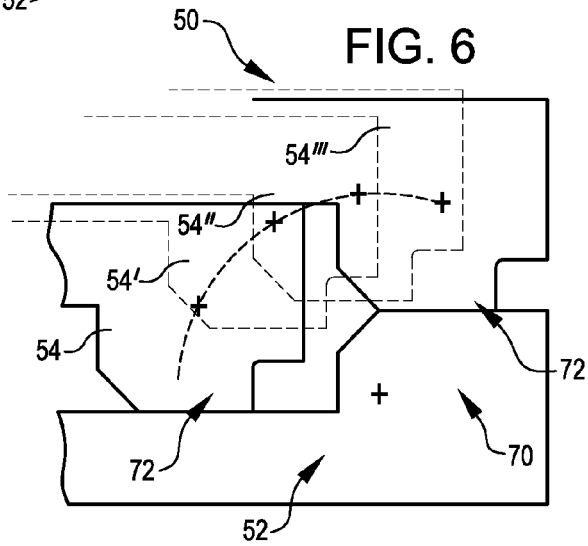
FIG. 6 is a side view of a portion the parallelogram frame shown in FIGS. 4 and 5, wherein a transition between retracted and extended positions is illustrated.

FIG. 6 shows the transition of a portion of parallelogram frame 50 from a retracted to an extended position. The upper beam 54 is shown in a retracted position and in intermediate positions, 54', 54", and in an extended position 54'". During the transition, upper beam 54 passes through a maximally extended position when the connector arms 56, 56' (not shown in FIG. 6) is vertical. In the maximally extended position, the vertical force in the upper beam 54 is transmitted to the lower beam 52 without allowing the beams 52 and 54 to come together under the vertical force. In all other positions, the vertical force on the upper beam 54 serves to displace the upper beam 54 on the connector arms 56, 56', bringing the upper beam 54 into either a retracted or an extended position, depending upon which side of the maximally extended over a center position the upper beam 54 is in when the force is applied.

Parallelogram frame 50 is removable from the disclosed speed bump device for repair or maintenance and any covering road surface element 12 may be also be replaced, such that a road is useable after such removal.

Figure 7:
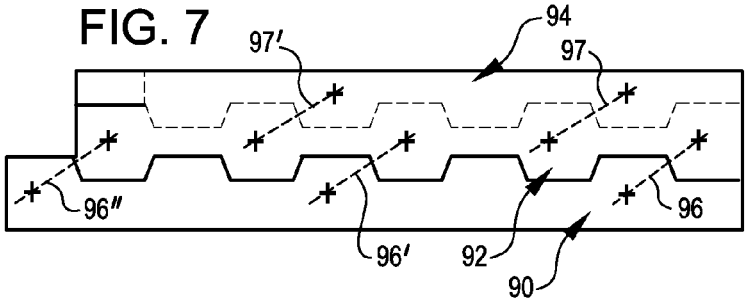
FIG. 7 is a side view of a parallelogram frame of the speed bump device shown in FIG. 3, arranged in a retracted position.
Figure 8:
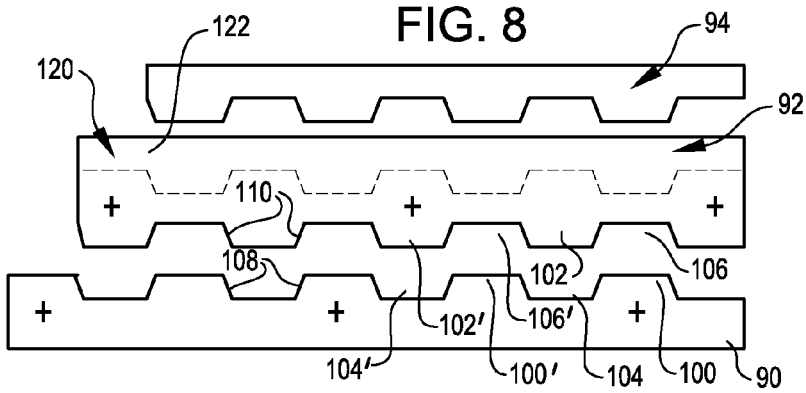
FIG. 8 is an exploded view of the parallelogram frame shown in FIG. 7.
Figure 9:
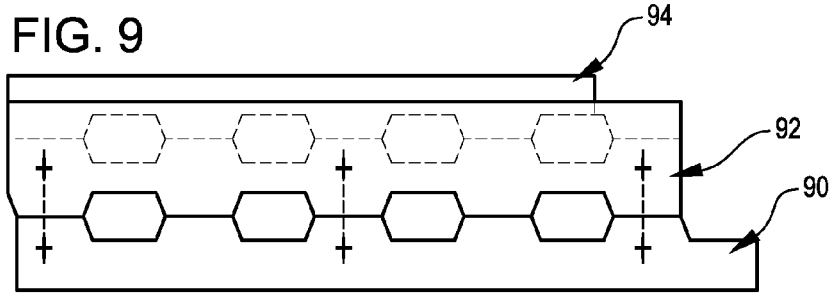
FIG. 9 is a side view of the parallelogram frame shown in FIG. 7, arranged in an extended position.

FIGS. 7 to 9 show a parallelogram frame for use with the speed bump device as shown in FIG. 3. This frame comprises a lower beam 90, an upper beam 92, and an uppermost beam 94. The lower beam 90 is connected to the upper beam by way of pivotable arms 96, 96', 96". The upper beam 92 is connected to the uppermost beam 94 by way of pivotable arms 97, 97'. As shown in FIG. 8, the upper beam 92 is nested in the lower beam 90 by way of a plurality of lands 100, 100' and wells 104, 104' in the lower beam 90, and extensions 102, 102' and indents 106, 106' in the upper beam 92. The extensions 102, 102' enter the wells 104, 104' when the frame is in a retracted position (FIG. 7). When the frame is in an extended position (FIG. 9), extensions 102, 102' of upper beam 92 rest on lands 100, 100' of lower beam 90. The lands 100, 100' and extensions 102, 102' have bevelled sides 108, 110, allowing lands 100, 100' and extensions 102, 102' to be rotated on pivotable arms 96, 96', 96", in and out of indents 104, 104' and wells 106, 106' respectively. As shown in FIG. 8, the upper beam 92 is similarly arranged with the uppermost beam 94. Uppermost beam 94 nests in a U-shaped recess 120 outer between walls 122 of the upper beam 92.

Figure 10:
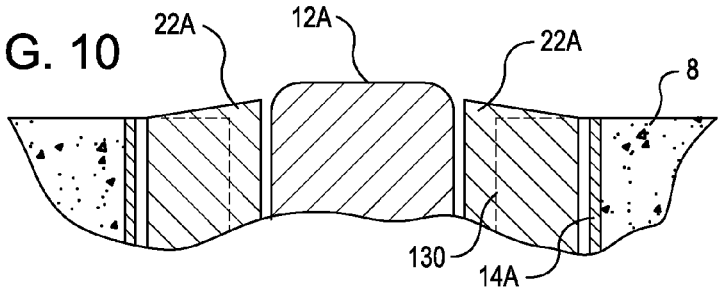
FIG. 10 is a partial cross-sectional end view of the speed bump device as shown in FIG. 3, in a fully extended position.
Figure 11:
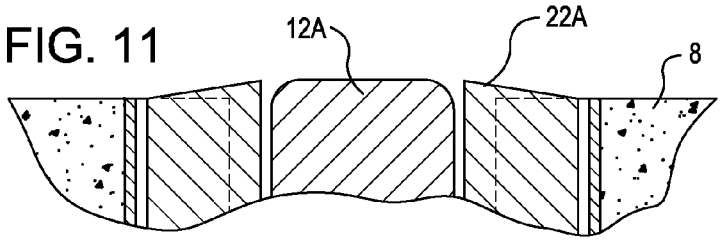
FIG. 11 shows the speed bump device of FIG. 10 in a partially retracted position.
Figure 12:
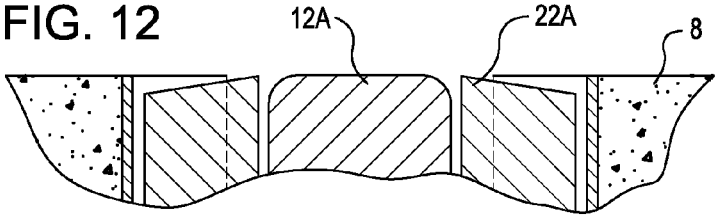
FIG. 12 shows the speed bump device of FIG. 10 in a fully retracted position.
Figure 13:
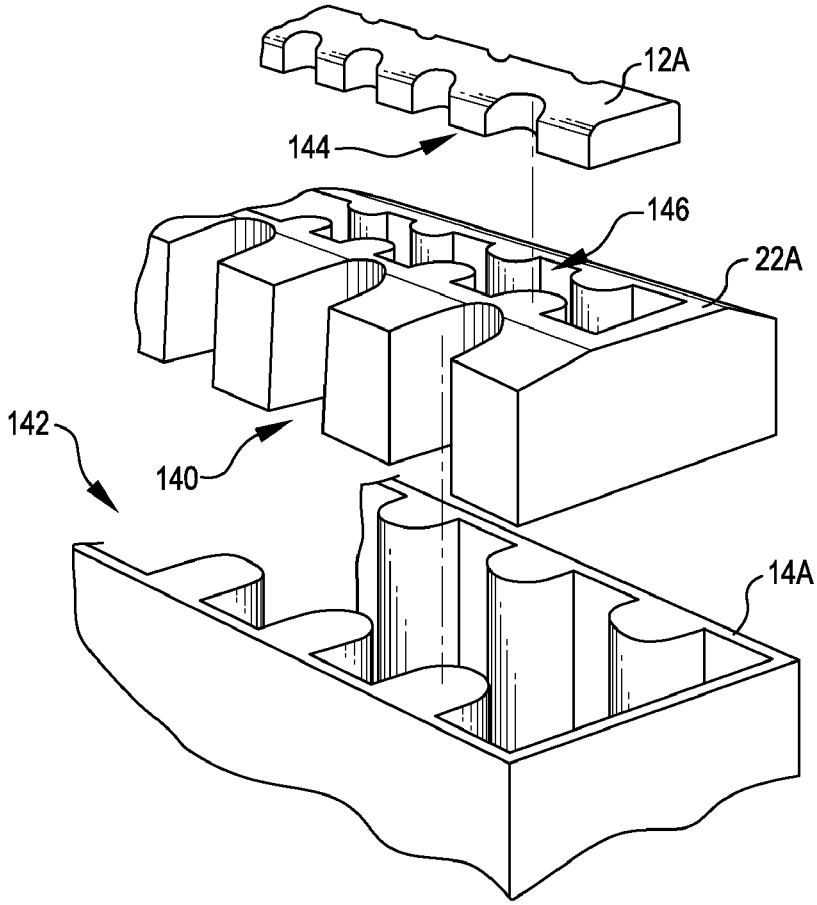
FIG. 13 is an exploded perspective view of road section elements for use with the speed bump device as shown in FIG. 3.

FIGS. 10 to 12 show various positions in which road surface elements 12A, 22A of yet another embodiment of the disclosed speed bump device can be arranged. In this embodiment, the speed bump device comprises at least one central road surface element 12A and at least one flanking road surface element 22A. Elements 12A and 22*a* are positioned in a frame 14A of the device, which is secured in a road having an adjacent surface 8. Flanking elements 22A are provided with scalloped edges 140, which match complementary scalloped edges 142 in frame 14A as shown in FIG. 13. Central element 12A is provided with scalloped edges 144 (shown in FIG. 13), which match complementary inner scalloped edges 146 in flanking elements 22A. Dashed line 130 illustrates the overlapping of scalloped edge of frame 14A provided with the flanking elements 22A. The central road surface element 12A is operable by the uppermost beam 94 and is surrounded by a road surface element 22A, operable by the upper beam 92.

In one embodiment, the road surface elements are provided with straight edges. In another embodiment, the road surface elements are provided with scalloped, castellated, or zigzag edges, which can be mated with complementary edges of adjacent road surface elements. The scalloped edges serve to smooth the transition of vehicle wheels between a road and a road surface element, and between road surface elements. In addition, the scalloped edges serve to reduce any twisting moment imparted on the speed bump device by a vehicle traversing the device obliquely.

In other embodiments, the upper 92 and uppermost 94 beams, as shown in FIGS. 7 to 9, may both be covered by a common road surface element to give two levels of extension for that road surface element. Hence, the disclosed speed bump device employing a first and a second parallelogram frame provides a single speed bump having two levels of extension.

In another embodiment, the road surface element 12 may be used to control traffic when element 12 comprises a first (or low) level of extension to target vehicles travelling slowly and a second (or higher) level of extension to target vehicle travelling faster. The speed bump device may also be utilized to reduce bump severity when a vehicle approaching at a speed such that a higher bump would risk causing the vehicle to run out of control.

In yet another embodiment, the speed bump device may be provided with a slip-clutch arrangement between the actuating mechanism and the connector arms 56, 56', such that when the speed bump device is not in either a fully extended or retracted position, in which one beam rests on the next, a vehicle passing over the device may force the bump into one or other of said positions, independent of the actuating mechanism, so as to protect the actuating mechanism from damage.

In still another embodiment, a flexible mat, constructed of durable plastics material or rubber, may be fixed over the entire top surface of the speed bump device to provide the road surface. The mat may be flat, humped, or depressed, depending on whether the bump is deployed and what form it takes. Such a mat may be connected to the vertically slidable road surface element or elements, as previously described, by a plurality of spaced attachment points. The spaced attachments may be a series of studs provided transversely across the road surface, which can additionally serve to mark the position of the bump, or the top of the bump profile (when deployed). The studs may be flat topped and can be countersunk into the mat, and they can be used to mount reflectors.

In a further embodiment, the disclosed speed bump device comprises at least three parallelogram frames. Alternatively, the speed bump device may comprise a plurality of frames in a parallel series, which may be used to support a single wide road surface element or a plurality of sequential road surface elements to provide a ripple road surface effect when extended.

While certain embodiments of the disclosed invention have been described in detail, it will be understood that various changes could be made in the above devices without departing from the scope of the invention. It is thus intended that all matter contained in the above description or shown in the accompanying drawings shall be interpreted as being illustrative and not limiting.

I claim:

1. A speed bump device comprising a first parallelogram frame and a road surface element, wherein the frame comprises an upper nested beam and a lower nested beam, wherein the upper beam is covered by the road surface element, wherein the upper beam and the lower beam are connected by way of at least two pivotable connecting arms, wherein the lower beam comprises a castellated upper surface having at least one raised land and at least one well, wherein the upper beam comprises a castellated profile on its lower surface, the castellated profile comprising at least one extension and at least one indent, wherein the upper beam is displaceable, relative to the lower beam, by way of the at least two connecting arms, from a refracted position, wherein the at least one extension nests in the at least one well of the lower beam, though a maximally extended position, to a raised position, wherein the at least one extension rests upon the at least one land of the lower beam.

2. The speed bump device according to claim 1, further comprising guide means which constrain the road surface element to move upwards and downwards by way of the first parallelogram frame.

3. The speed bump device according to claim 1, wherein the road surface element comprises at least one scalloped, castellated, or zigzag edge.

4. The speed bump device according to claim 1, wherein the road surface element comprises at least one straight edge.

5. The speed bump device according to claim 1, wherein the road surface element comprises a tray filled with at least one road-surfacing component.

6. A speed bump device comprising a first parallelogram frame, a second parallelogram frame, and at least one road surface element, wherein the first parallelogram frame comprises an upper nested beam and a lower nested beam, wherein the upper beam and the lower beam are connected by way of at least two pivotable connecting arms, wherein the lower beam comprises a castellated upper surface having at least one raised land and at least one well, wherein the upper beam comprises a castellated profile on its lower surface, the castellated profile comprising at least one extension and at least one indent, wherein the upper beam is displaceable, relative to the lower beam, by way of the at least two connecting arms, from a retracted position, wherein the at least one extension nests in the at least one well of the lower beam, through a maximally extended position, to a raised position, wherein the at least one extension rests upon the at least one land of the lower beam, wherein the second parallelogram frame comprises an uppermost nested beam and the aforesaid upper nested beam connected by way of at least two upper pivotable connecting arms, wherein the upper beam and the uppermost beam are covered by the at least one road surface element, wherein the upper beam comprises at least one depression and at least one raised section, and wherein the uppermost beam is displaceable, relative to the upper beam, by way of the at least one connecting arm, from a retracted position where it nests in the depression or depressions of the upper beam, through a maximally extended position, to a raised position where it rests upon the at least one raised section of the upper beam.

7. The speed bump device according to claim 6, further comprising at least two road surface elements covering the upper beam and the uppermost beam.

8. The speed bump device according to claim 7, wherein the upper beam and the uppermost beam are each capable of operating and moving separate road surface elements.

9. The speed bump device according to claim 7, wherein the road surface element operated by the uppermost beam is flanked by a road surface element operated by the upper beam.

10. The speed bump device according to claim 7, further comprising guide means which constrain the at least one road surface element to move upwards and downwards by way of the first and second parallelogram frames.

11. The speed bump device according to claim 6, wherein the at least one road surface element comprises at least one straight edge.

12. The speed bump device according to claim 6, wherein the at least one road surface element comprises at least one scalloped, castellated, or zigzag edge.

13. The speed bump device according to claim 6, wherein the at least one road surface element comprises a tray filled with at least one road-surfacing component.

* * * * *